US009838823B2

(12) United States Patent
Song et al.

(10) Patent No.: US 9,838,823 B2
(45) Date of Patent: Dec. 5, 2017

(54) AUDIO SIGNAL PROCESSING METHOD

(71) Applicant: INTELLECTUAL DISCOVERY CO., LTD., Seoul (KR)

(72) Inventors: Jeongook Song, Seoul (KR); Myungsuk Song, Seoul (KR); Hyun Oh Oh, Seongnam-si (KR); Taegyu Lee, Seoul (KR)

(73) Assignee: INTELLECTUAL DISCOVERY CO., LTD., Seoul (KR)

( * ) Notice: Subject to any disclaimer, the term of this patent is extended or adjusted under 35 U.S.C. 154(b) by 0 days.

(21) Appl. No.: 14/786,604

(22) PCT Filed: Apr. 24, 2014

(86) PCT No.: PCT/KR2014/003575
§ 371 (c)(1),
(2) Date: Oct. 23, 2015

(87) PCT Pub. No.: WO2014/175668
PCT Pub. Date: Oct. 30, 2014

(65) Prior Publication Data

US 2016/0080884 A1 Mar. 17, 2016

(30) Foreign Application Priority Data

Apr. 27, 2013 (KR) ..... 10-2013-0047052
Apr. 27, 2013 (KR) ..... 10-2013-0047053
Apr. 27, 2013 (KR) ..... 10-2013-0047060

(51) Int. Cl.
*H04S 7/00* (2006.01)
*H04S 5/00* (2006.01)
(Continued)

(52) U.S. Cl.
CPC ..... *H04S 7/302* (2013.01); *G10L 19/008* (2013.01); *H04S 5/005* (2013.01); *H04S 3/008* (2013.01);
(Continued)

(58) Field of Classification Search
CPC ..... H04S 7/302; H04S 2400/03; H04S 5/005; H04S 3/008; H04S 2400/11; H04S 2400/15; G10L 19/008
See application file for complete search history.

(56) References Cited

U.S. PATENT DOCUMENTS 8,213,641 B2 7/2012 Faller et al.
2007/0140498 A1* 6/2007 Moon ..... H04S 5/005 381/20
(Continued)

FOREIGN PATENT DOCUMENTS

KR 10-0803212 B1 2/2008
KR 10-2010-0096537 A 9/2010
(Continued)

OTHER PUBLICATIONS

International Search Report for PCT/KR2014/003575 dated Aug. 21, 2014.

*Primary Examiner* — Sonia Gay
(74) *Attorney, Agent, or Firm* — Sughrue Mion, PLLC

(57) ABSTRACT

Disclosed is an audio signal processing method. The audio signal processing method according to the present invention comprises the steps of: receiving a bit-stream including at least one of a channel signal and an object signal; receiving a user's environment information; decoding at least one of the channel signal and the object signal on the basis of the received bit-stream; generating the user's reproducing channel information on the basis of the user's received environment information; and generating a reproducing signal through a flexible renderer on the basis of at least one of the
(Continued)

channel signal and the object signal and the user's reproducing channel information.

11 Claims, 9 Drawing Sheets

(51) Int. Cl.
*H04S 3/00* (2006.01)
*G10L 19/008* (2013.01)

(52) U.S. Cl.
CPC ..... *H04S 2400/03* (2013.01); *H04S 2400/11* (2013.01); *H04S 2400/15* (2013.01)

(56) References Cited

U.S. PATENT DOCUMENTS

| | | | | |
|---|---|---|---|---|
| 2007/0165139 | A1* | 7/2007 | Eleftheriadis ..... | G11B 27/034 348/565 |
| 2007/0233296 | A1 | 10/2007 | Kim et al. | |
| 2009/0112606 | A1 | 4/2009 | Mehrotra et al. | |
| 2012/0033816 | A1 | 2/2012 | Lee et al. | |
| 2015/0350802 | A1* | 12/2015 | Jo ..... | H04S 5/005 381/1 |
| 2016/0029138 | A1* | 1/2016 | France ..... | G10L 19/008 381/23 |

FOREIGN PATENT DOCUMENTS

| | | | |
|---|---|---|---|
| KR | 10-1122093 | B1 | 3/2012 |
| KR | 10-2012-0013887 | A | 8/2014 |

* cited by examiner

AUDIO SIGNAL PROCESSING METHOD

TECHNICAL FIELD

The present invention generally relates to an audio signal processing method, and more particularly to a method for encoding and decoding an object audio signal and for rendering the signal in 3-dimensional space. This application claims the benefit of Korean Patent Applications No. 10-2013-0047052, No. 10-2013-0047053, and No. 10-2013-0047060, filed Apr. 27, 2013, which are hereby incorporated by reference in their entirety into this application.

BACKGROUND ART 3D audio is realized by providing a sound scene (2D) on a horizontal plane, which existing surround audio has provided, with another dimension in the direction of height. 3D audio literally refers to various techniques for providing fuller and richer sound in 3-dimensional space, such as signal processing, transmission, encoding, reproduction techniques, and the like. Specifically, in order to provide 3D audio, a large number of speakers than that of conventional technology are used, or alternatively, rendering technology is widely required which forms sound images at virtual locations where speakers are not present, even if a small number of speakers are used.

3D audio is expected to be an audio solution for a UHD TV to be launched soon, and is expected to be variously used for sound in vehicles, which are developing into spaces for providing high-quality infotainment, as well as sound for theaters, personal 3D TVs, tablet PCs, smart phones, cloud games, and the like.

Meanwhile, MPEG 3D audio supports a 22.2-multichannel system as a main format to provide high-quality service. This is a method proposed by NHK, in which top and bottom layers are added to form a multi-channel audio environment because surround channel speakers at the height of the user's ear level are not enough to provide such a multi-channel environment. In the top layer, a total of 9 channels may be provided. Specifically, a total of 9 speakers are arranged in such a way that 3 speakers are arranged at the front, center, and back positions. In the middle layer, 5, 2, and 3 speakers are respectively arranged at the front, center, and back positions. On the floor, 3 speakers are arranged at the front, and 2 LFE channels may be installed.

Generally, a specific sound source may be located in the 3-dimensional space by combining the outputs of multiple speakers (Vector Base Amplitude Panning: VBAP). Using amplitude panning, which determines the direction of a sound source between two speakers based on the signal amplitude, or using VBAP, which is widely used for determining the direction of a sound source using three speakers in 3-dimensional space, rendering may be conveniently implemented for the object signal, which is transmitted on an object basis.

In other words, a virtual speaker 1 may be generated using three speakers (channel 1, 2, and 3). VBAP is a method for generating an object vector in which the virtual source will be located based on the position of a listener (sweet spot), and the method renders a sound source by selecting speakers around the listener and calculating a gain value for controlling the speaker positioning vector. Therefore, for object-based content, at least three speakers surrounding the target object (or the virtual source) are determined, and VBAP is reconfigured according to the relative positions of the speakers, whereby the object may be reproduced at a desired position.

DISCLOSURE

Technical Problem

In 3D audio, it is necessary to transmit signals having up to 22.2 channels, which is higher than the number of channels in the conventional art, and to this end, an appropriate compression and transmission technique is required.

Conventional high-quality encoding, such as MP3, AAC, DTS, AC3, etc., is optimized to transmit a signal having 5.1 or fewer channels. Also, to reproduce a 22.2-channel signal, an infrastructure for a listening room in which a 24-speaker system is installed is required. However, this infrastructure may not spread on the market in a short time. Therefore, required are a technique for effectively reproducing 22.2-channel signals in space in which the number of speakers that are installed is lower than the number of channels; a technique for reproducing an existing stereo or 5.1-channel sound source in a 10.1-, 22.2-channel environment, in which the number of speakers that are installed is higher than the number of channels; a technique that enables providing a sound scene offered by an original sound source in a space in which a designated speaker arrangement and a designated listening environment are not provided; a technique that enables enjoying 3D sound in a headphone listening environment; and the like. These techniques are commonly called rendering, and specifically, they are respectively called downmixing, upmixing, flexible rendering, and binaural rendering.

Meanwhile, as an alternative for effectively transmitting a sound scene, an object-based signal transmission method is required. Depending on the sound source, transmission based on objects may be more advantageous than transmission based on channels, and in the case of the transmission based on objects, interactive listening to a sound source is possible, for example, a user may freely control the reproduced size and position of an object. Accordingly, an effective transmission method that enables an object signal to be compressed so as to be transmitted at a high transmission rate is required.

Also, there may be a sound source in which a channel-based signal and an object-based signal are mixed, and through such a sound source, a new listening experience may be provided. Therefore, a technique for effectively transmitting both the channel-based signal and the object-based signal at the same time is necessary and a technique for effectively rendering the signals is also required.

Finally, there may be exceptional channels, of which the signals are difficult to reproduce using existing methods due to the distinct characteristics of the channels and the speaker environment in the reproduction environment. In this case, a technique for effectively reproducing the signals of the exceptional channels based on the speaker environment at the reproduction stage is required.

Technical Solution

To accomplish the above object, an audio signal processing method according to the present invention includes: receiving a bit-stream including at least one of a channel signal and an object signal; receiving user environment information; decoding at least one of the channel signal and the object signal based on the received bit-stream; generating user reproduction channel information using the received user environment information; and generating a reproduction signal through a flexible renderer based on the user reproduction channel information and at least one of the channel signal and the object signal.

Generating the user reproduction channel information may determine whether a number of the user reproduction channels is identical to a number of channels of a standard specification, based on the received user environment information.

When the number of the user reproduction channels is identical to the number of channels of the standard specification, the decoded object signal may be rendered according to the number of the user reproduction channels, and when the number of the user reproduction channels is not identical to the number of channels of the standard specification, the decoded object signal may be rendered in response to the next highest number of channels of the standard specification.

When the channel signal is in the rendered object signal, the channel signal to which the object signal is added is transmitted to a flexible renderer, and the flexible renderer may generate a final output audio signal that is rendered by matching the channel signal to which the object signal is added with the number and a position of the user reproduction channels.

Generating the reproduction signal may generate a first reproduction signal in which the decoded channel signal and the decoded object signal are added, using information about change of the user reproduction channel.

Generating the reproduction signal may generate a second reproduction signal in which the decoded channel signal and the decoded object signal are included, using information about change of the user reproduction channel.

Generating information about change of the user reproduction channel may distinguish an object included in a space range, in which the object is reproducible based on a changed speaker position, from an object that is not included in the space range, in which the object is reproducible.

Generating the reproduction signal may include: selecting a channel signal that is closest to the object signal using position information of the object signal; and multiplying the selected channel signal by a gain value, and combining a result with the object signal.

Selecting the channel signal may include: selecting 3 of channel signals that are adjacent to the object when the user reproduction channel includes 22.2 channels; and multiplying the object signal by a gain value, and combining a result with the selected channel signals.

Selecting the channel signal may include: selecting 3 or fewer channel signals that are adjacent to the object when the user reproduction channel does not include 22.2 channels; and multiplying the object signal by a gain value that is calculated using sound attenuation information according to a distance, and combining a result with the selected channel signal.

Receiving the bit-stream comprises receiving a bit-stream further including object end information. Decoding at least one of the channel signal and the object signal comprises decoding the object signal and the object end information, using the received bit-stream and received user environment information, and decoding may further include: generating a decoding object list using the received bit-stream and the received user environment information; generating an updated decoding object list using the decoded object end information and the generated decoding object list; and transmitting the decoded object signal and the updated decoding object list to the flexible renderer.

Generating the updated decoding object list may be configured to remove a corresponding item of an object that includes the object end information from the decoding object list that is generated from object information of a previous frame, and add a new object.

Generating the updated decoding object list may include: storing a frequency of use of a past object; and being substituted by a new object using the stored frequency of use.

Generating the updated decoding object list may include: storing a usage time of a past object; and being substituted by a new object using the stored usage time.

The object end information may be implemented by adding one or more bits of different additional information to an object sound source header according to a reproduction environment.

The object end information is capable of reducing traffic.

Advantageous Effects

According to the present invention, a piece of content that is once generated (for example, signals that are encoded based on 22.2 channels) may be used in various speaker configurations and reproduction environments.

Also, according to the present invention, an object signal may be decoded properly in consideration of the position of user speakers, resolutions, maximum object list space, and the like.

Also, according to the present invention, there is an advantage in terms of the traffic and computational load between a decoder and a renderer.

BEST MODE

Figure 1:
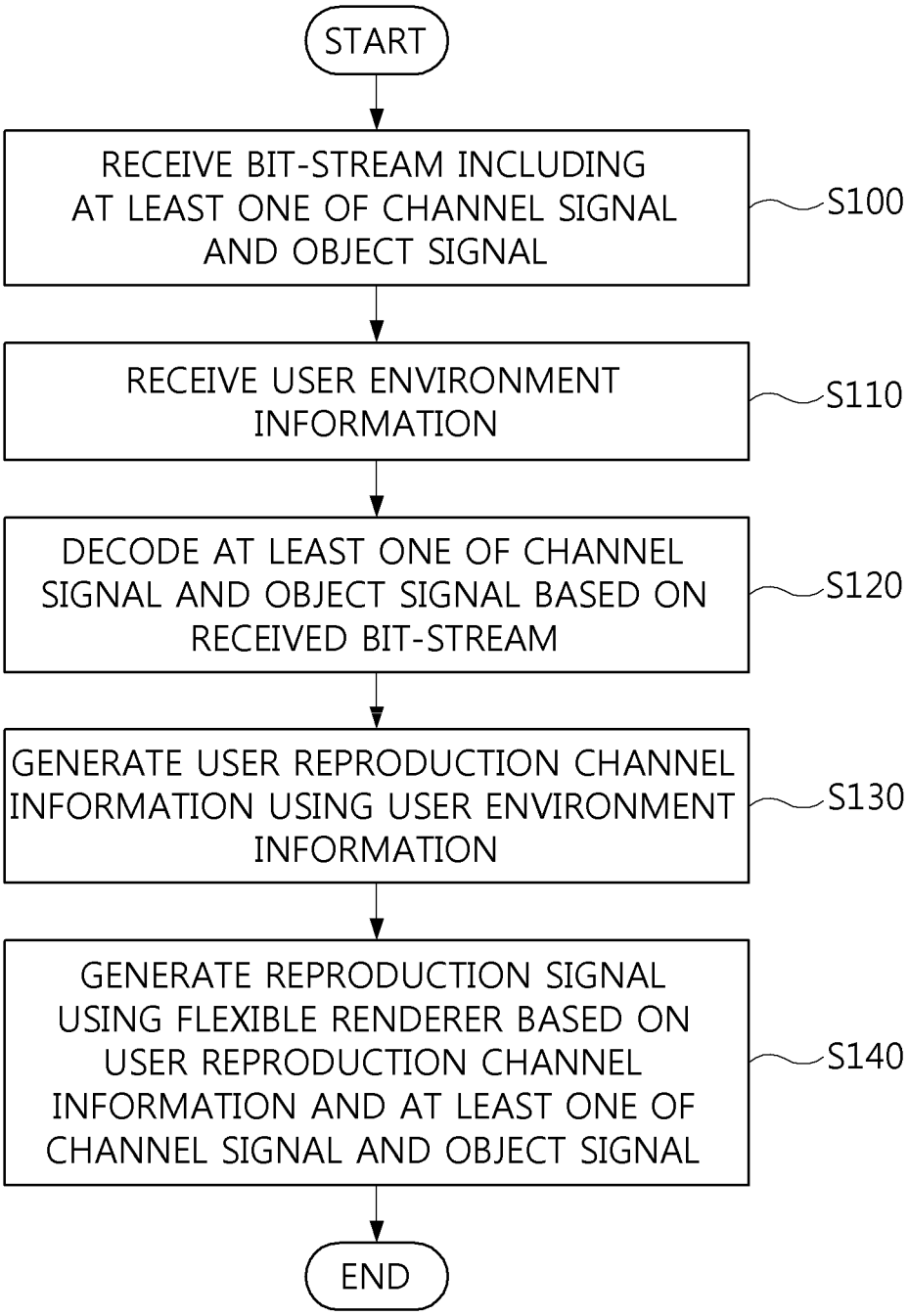
FIG. 1 is a flowchart of an audio signal processing method according to the present invention.

The present invention is described in detail below with reference to the accompanying drawings. Repeated descriptions, as well as descriptions of known functions and configurations which have been deemed to make the gist of the present invention unnecessarily obscure, will be omitted below.

The embodiment described in this specification is provided for allowing those skilled in the art to more clearly comprehend the present invention. The present invention is not limited to the embodiment described in this specification, and the scope of the present invention should be construed as including various equivalents and modifications that can replace the embodiments and the configurations at the time at which the present application is filed. The terms in this specification and the accompanying drawings are for easy description of the present invention, and the shape and size of the elements shown in the drawings may be exaggeratedly drawn. The present invention is not limited to the terms used in this specification or the accompanying drawings.

In the following description, when the functions of conventional elements and the detailed description of elements related with the present invention may make the gist of the present invention unclear, a detailed description of those elements will be omitted.

In the present invention, the following terms may be construed based on the following criteria, and terms which are not used herein may also be construed based on the following criteria. The term "coding" may be construed as encoding or decoding, and the term "information" includes values, parameters, coefficients, elements, etc., and the meanings thereof may be differently construed according to the circumstances, and the present invention is not limited thereto.

Hereinafter, referring to the accompanying drawings, an audio signal processing method according to the present invention is described.

FIG. 1 is a flowchart of an audio signal processing method according to the present invention.

Described with reference to FIG. 1, the audio signal processing method according to the present invention includes: receiving a bit-stream including at least one of a channel signal and an object signal (S100), receiving user environment information (S110), decoding at least one of the channel signal and the object signal, based on the received bit-stream (S120), generating user reproduction channel information using the received user environment information (S130), and generating a reproduction signal through a flexible renderer, based on the user reproduction channel information and at least one of the channel signal and the object signal (S140).

Hereinafter, the audio signal processing method according to the present invention is described in more detail.

Figure 2:
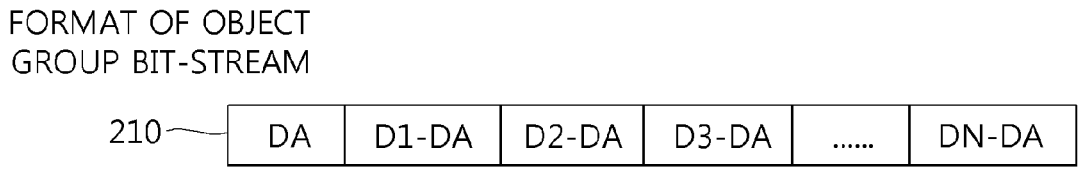
FIG. 2 is a view describing the format of an object group bit-stream according to the present invention.

FIG. 2 is a view describing the format of an object group bit-stream.

Described with reference to FIG. 2, based on an audio feature, multiple object signals are included in a single group, and generate a bit-stream 210.

The bit-stream of the object group is comprised of a bit-stream of a signal DA, in which all objects are included, and individual object bit-streams. The individual object bit-streams are generated by the difference between the DA signal and the signal of a corresponding object. Therefore, an object signal is acquired using the addition of a decoded DA signal and signals that are obtained by decoding the individual object bit-streams.

Figure 3:
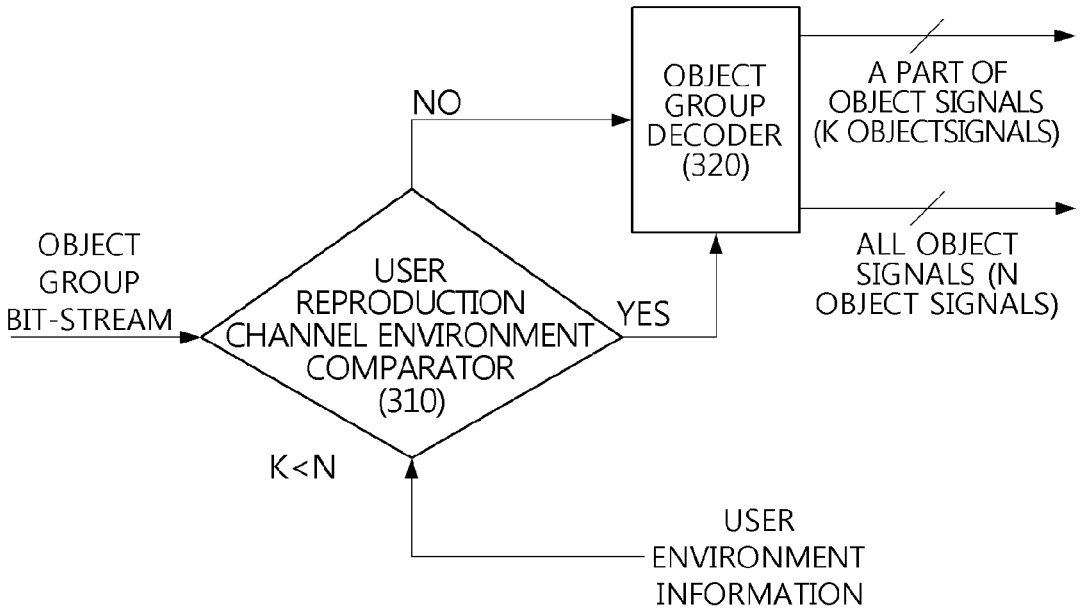
FIG. 3 is a view describing the process in which, in an object group, the number of objects to be decoded is selectively determined using user environment information.

FIG. 3 is a view describing the process whereby, in an object group, the number of objects to be decoded is selectively determined using user environment information.

Object bit-streams, numbering as many as the number that is selected according to the input user environment information, are decoded. If the number of user reproduction channels within the area that is formed by the position information of the received object group bit-stream is as high as proposed by a standard specification, all of the objects (N objects) in the group are decoded. However, if not, a signal (DA), which adds all the objects, along with some object signals (K object signals), are decoded.

The present invention is characterized in that the number of objects to be decoded is determined by the resolution of a user reproduction channel in the user environment information. Also, a representative object in the group is used when the resolution of the user reproduction channel is low and when each of the objects is decoded. An embodiment for generating a signal that adds all the objects included in a group is as follows.

Attenuation according to the distance between a representative object and other objects in a group is computed according to Stokes' law and added. If the first object is D1, other objects are D2, D3, . . . , Dk, and a is a sound attenuation constant based on frequency and spatial density, the signal DA in which the representative object in the group is added is given by the following Equation 1.

$$DA=D1+D2\exp(-a\cdot d_1)+D3\exp(-a\cdot d_2)+\ldots+Dk\exp(-a\cdot d_{k-1}) \quad \text{[Equation 1]}$$

In the above Equation 1, $d_1, d_2, \ldots, d_k$ mean the distance between each object and the first object.

The first object is determined to be the object of which the physical position is closest to the position of a speaker that is always present regardless of the resolution of a user reproduction channel, or the object that has the highest loudness level based on the speaker.

Also, when the resolution of a user reproduction channel is low, the method for determining whether an object in a group is decoded is that the object is decoded when its perceived loudness at the position of the closest reproduction channel is higher than a certain level. As an alternative, simply, an object may be decoded when the distance between the object and the position of a reproduction channel is greater than a certain value.

Figure 4:
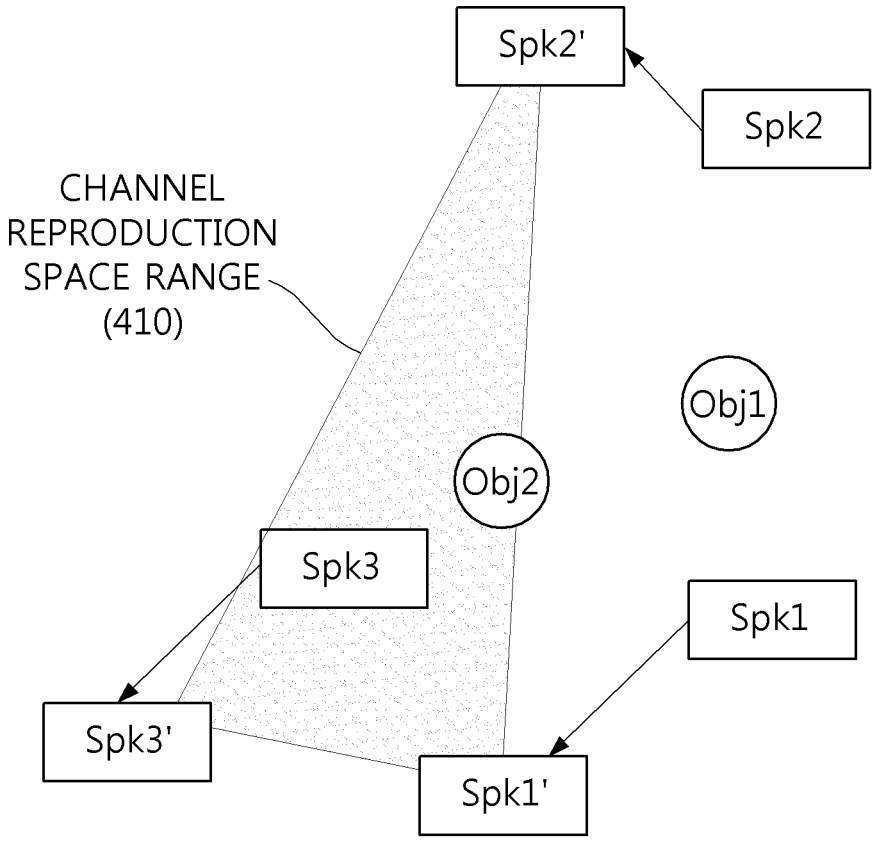
FIG. 4 is a view describing an embodiment of an object signal rendering method when the position of a user reproduction channel falls outside of the range designated by a standard specification.

FIG. 4 is a view describing an embodiment of an object signal rendering method when the position of a user reproduction channel falls outside of the range designated by a standard specification.

Specifically, referring to FIG. 4, it is confirmed that some object signals may not be rendered at desired positions when the position of a user reproduction channel falls outside of the range designated by a standard specification.

In this case, unless the positions of speakers have changed, two object signals may generate sound staging at the given positions using three speakers by a VBAP technique. However, because of the change in the position of the reproduction channel, there is an object signal that is not included in a channel reproduction space range 410, which is the space range in which an object signal may be reproduced by VBAP.

Figure 5:
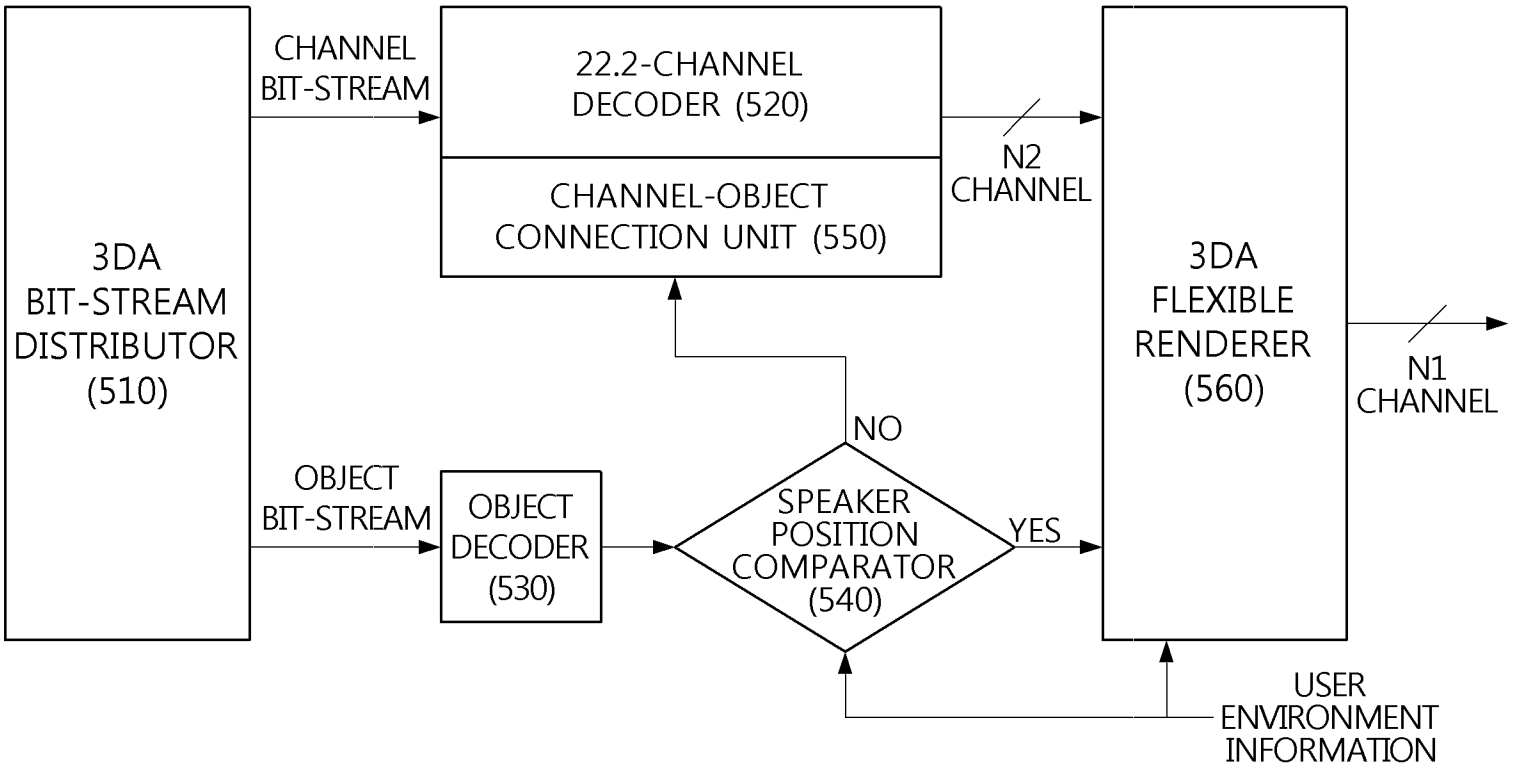
FIG. 5 is a view describing an embodiment in which an object signal according to the position of a user reproduction channel is decoded.

FIG. 5 is a view describing an embodiment in which an object signal according to the position of a reproduction channel is decoded. In other words, described is an object signal decoding method performed when the position of a user reproduction channel falls outside of the range designated by a standard specification, as illustrated in FIG. 4.

In this case, an object decoder 530 may include an individual object decoder, a parametric object decoder, and the like. As a typical example of the parametric object decoder, there is Spatial Audio Object Coding (SAOC).

Whether the position of a reproduction channel in user environment information corresponds to the range of a standard specification is checked, and if the position falls within the range, an object signal that has been decoded by an existing method is transmitted to a flexible renderer. However, if the position of the reproduction channel is very different from the standard specification, the channel signal to which the decoded object signal is added is transmitted to the flexible renderer, to obtain a reproduction channel.

In a detailed embodiment according to the present invention, a step for determining whether user environment information corresponds to the range designated by a standard specification includes determining whether it corresponds to the number of channels according to the standard specification (as a configuration according to the number of channels, 22.2, 10.1, 7.1, 5.1, etc.). Also, the step includes rendering of a decoded object. In this case, if the user environment information corresponds to the number of channels according to the standard, the decoded object is rendered based on the corresponding standard channels, but if not, the decoded object is rendered based on the next highest number of channels among the standard channel configurations. Also, the step includes transmitting the object, which has been rendered according to the standard channels, to a 3DA flexible renderer.

In this case, because the object signal that is input to the 3DA flexible renderer corresponds to the standard channels, the 3DA flexible renderer is implemented by performing flexible rendering according to the position of a user, without rendering of the object.

This implementation method has the effect of resolving unconformity between the spatial precision of object rendering and that of channel rendering.

An audio signal processing method according to the present invention discloses a technique for processing the audio signal of an object signal when the position of a user reproduction channel falls outside of the range designated by a standard specification.

Specifically, after channel decoding and object decoding are performed using the received bit-stream and user environment information, when a change occurs in the position of a user reproduction channel, whether there is an object signal that may not generate sound staging in a desired position using a flexible rendering technique is checked. If such an object signal exists, the object signal is mapped to a channel signal and transmitted to a flexible renderer, and if not, the object signal is directly transmitted to the flexible renderer.

Also, when an object signal is rendered in 3-dimensional space through a VBAP technique, there are an object signal Obj2, which falls within a channel reproduction space range 410, and an object signal Obj1, which falls outside of the channel reproduction space range 410, wherein the channel reproduction space range is a space range in which an object may be reproduced according to the changed position of a speaker, as in the embodiment of FIG. 4.

Also, when the object signal is mapped to a channel signal, the closest channel signals are searched for using the position information of the object signal, signals are multiplied by an appropriate gain value, and the object signal is added.

In this case, if the received user reproduction channel includes 22.2 channels, the 3 closest channel signals are searched for, the object signal is multiplied by a VBAP gain value, and the result is added to the channel signal. If the user reproduction channel does not 22.2 channels, the 3 or fewer closest channels are searched for, the object signal is multiplied by a sound attenuation constant, which is based on a frequency and spatial density, and by a gain value, which is inversely exponentially proportional to the distance between the object and the channel position, and the result is added to the channel signal.

Figure 6:
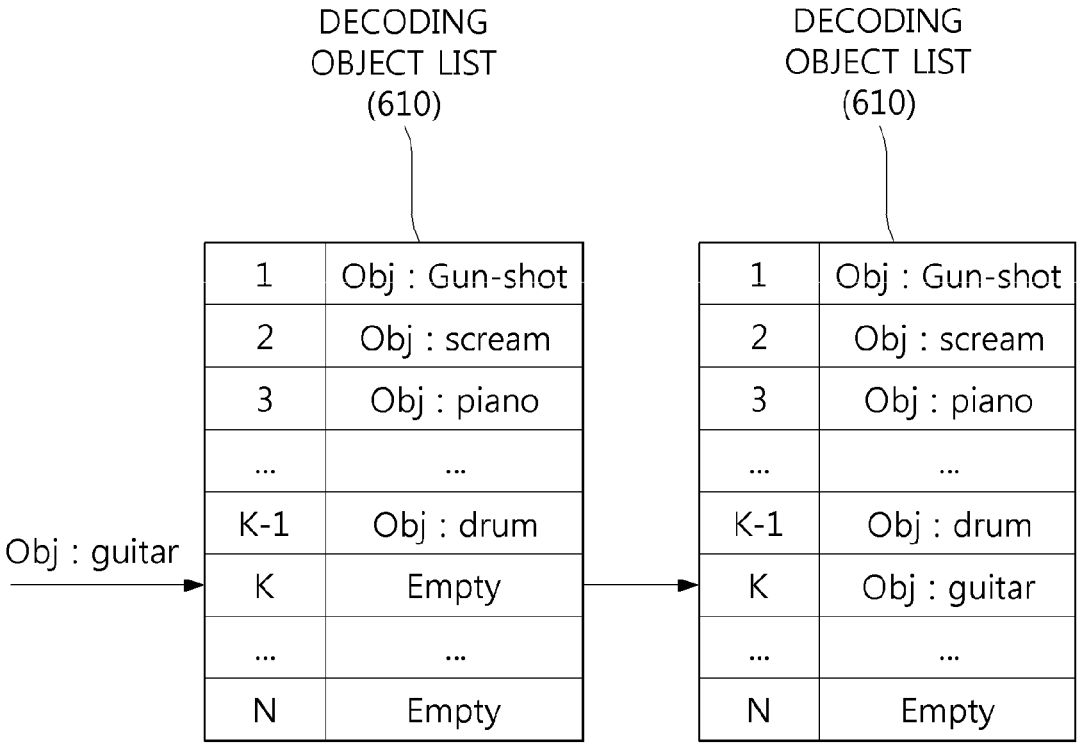
FIG. 6 is a view for explaining the problem caused when a decoding object list is updated without transmission of an END flag, and for explaining the case in which empty space is present in the decoding object list.
Figure 7:
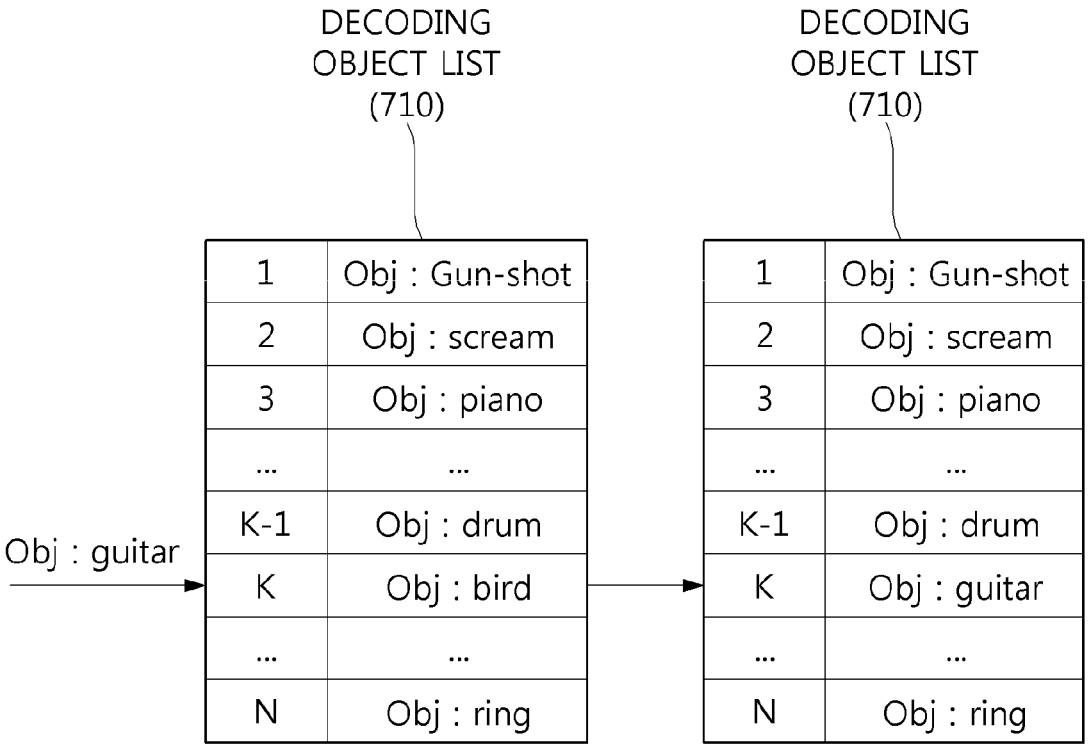
FIG. 7 is a view for explaining the problem caused when a decoding object list is updated without transmission of an END flag, and for explaining the case in which no empty space is present in the decoding object list.

FIG. 6 is a view for explaining the problem caused when a decoding object list is updated without transmission of an END flag, and for explaining the case in which empty space is present in the decoding object list. FIG. 7 is a view for explaining the problem caused when a decoding object list is updated without transmission of an END flag, and for explaining the case in which no empty space is present in the decoding object list.

Described with reference to FIG. 6, empty spaces are present from the k-th position of a decoding object list. When a new object signal is added to the list, the decoding object list is updated by putting the object signal in the k-th space. However, if the decoding object list is filled up as illustrated in FIG. 7, when a new object is added to the list, the object substitutes for an arbitrary object in the list.

Because the object being used is randomly substituted, the previous object signal cannot be used. This problem occurs whenever a new object is added.

Figure 8:
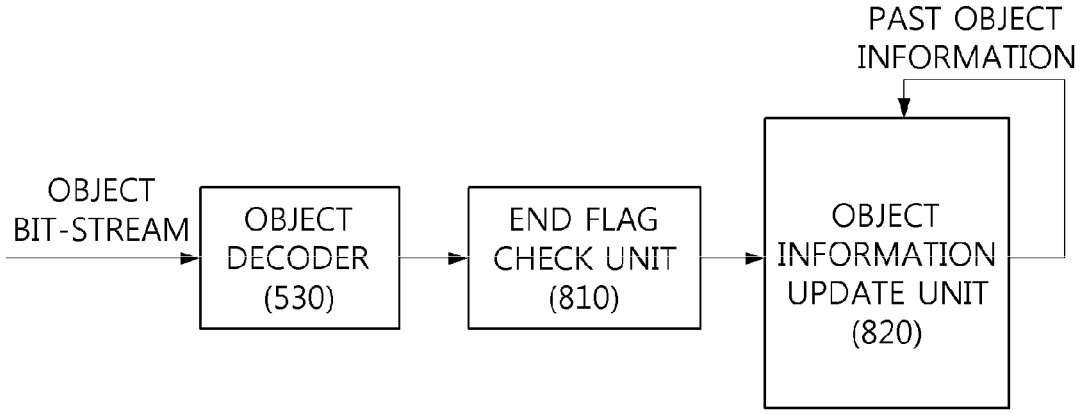
FIG. 8 is a view illustrating the structure of an object decoder including an END flag.
Figure 9:
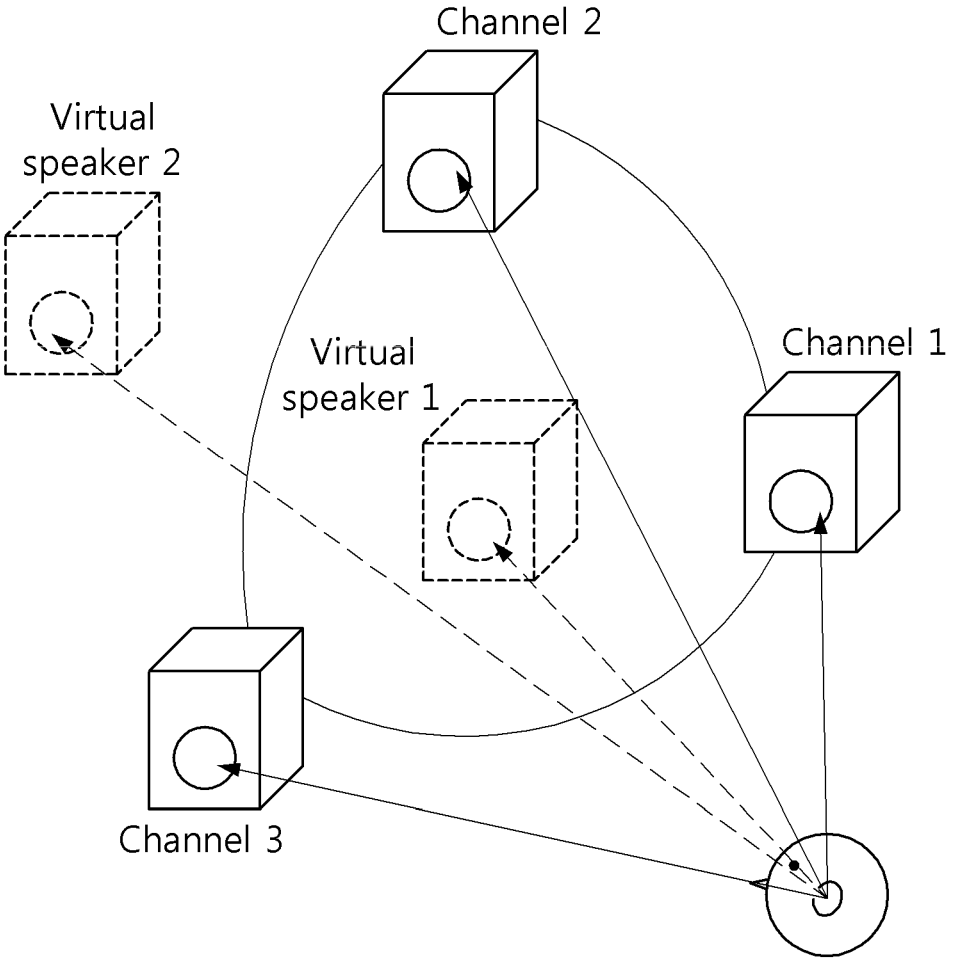
FIG. 9 is a view describing the concept of a rendering method (VBAP) using multiple speakers.

FIG. 8 is a view illustrating the structure of an object decoder including an END flag.

Described with reference to FIG. 8, an object bit-stream is decoded to object signals through an object decoder 530. An END flag is checked in the decoded object information, and a result is transmitted to an object information update unit 820. The object information update unit 820 receives the past object information and the current object information, and updates the data in a decoding object list.

An audio signal processing method according to the present invention is characterized in that an emptied decoding object list may be reused by transmitting an END flag.

The object information update unit 820 removes an unused object from the decoding object list, and increases the number of decodable objects on the receiver side, which has been determined by user environment information.

Also, by storing the frequency of use of the past object or the time of use of the past object, when there is no empty space in the decoding object list, the object having the lowest frequency of use or the earliest used object may be substituted with a new object.

Also, the END flag check unit 810 checks whether the set END flag is valid by checking a single bit of information corresponding to the END flag. As another operation method, it is possible to verify whether the set END flag is valid according to a value obtained by dividing the length of a bit-stream of the object by 2. These methods may reduce the amount of information that is used to transmit the END flag.

Hereinafter, referring to the drawing, an embodiment of an audio signal processing method according to the present invention is described.

Figure 10:
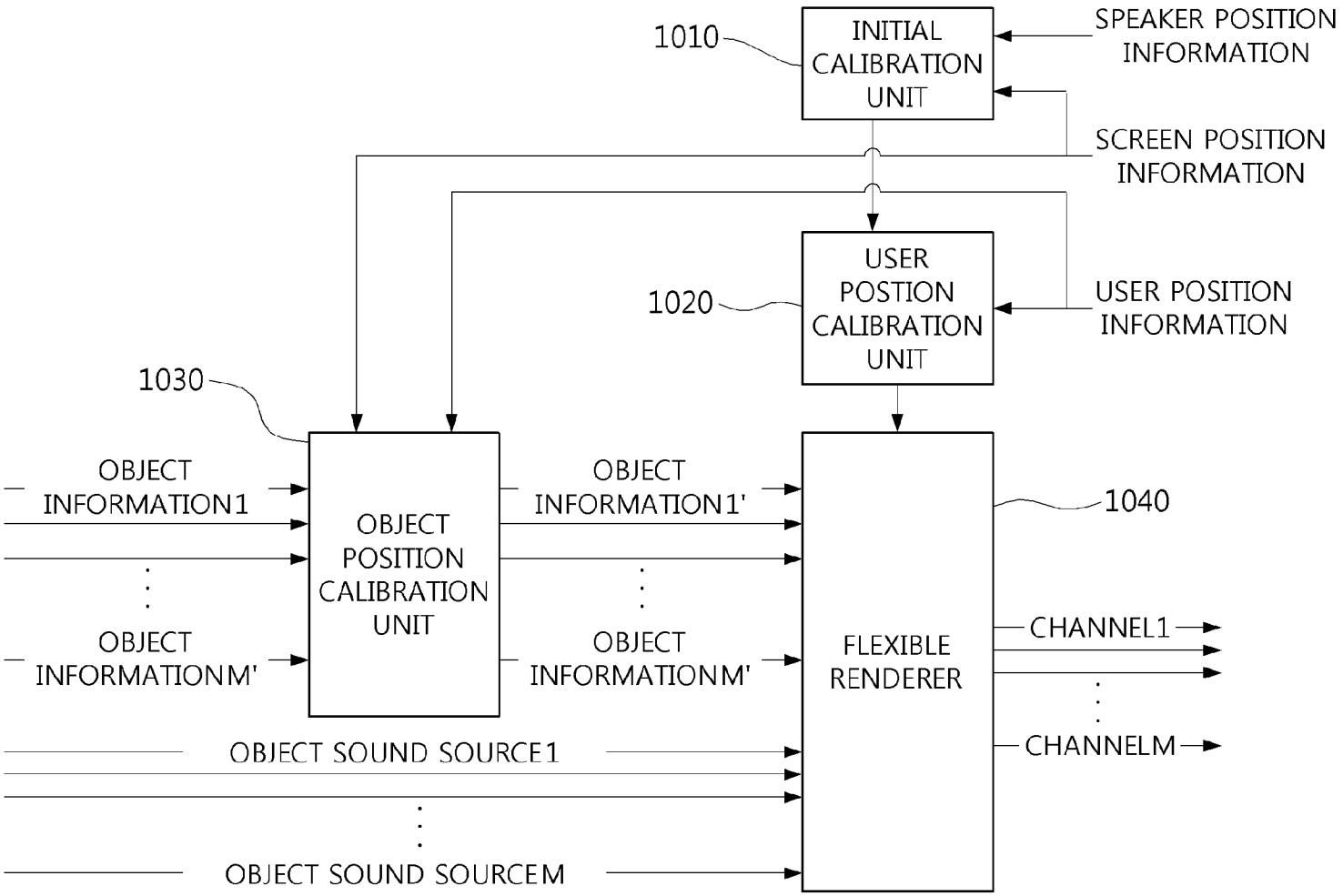
FIG. 10 is a view describing an embodiment of an audio signal processing method according to the present invention.

FIG. 10 is a view describing an embodiment of an audio signal processing method according to the present invention.

Described with reference to FIG. 10, an object position calibration unit 1030 updates the position information of an object sound source for lip synchronization, using the previously measured positions of a screen and a user. An initial calibration unit 1010 and a user position calibration unit 1020 serve to directly determine a constant value for a flexible rendering matrix, whereas the object position calibration unit performs a function for calibrating object sound source position information, which is used as an input of an existing flexible rendering matrix along with the object sound source signal.

If rendering of the transmitted object or channel signal is a relative rendering value based on a screen that is arranged to have a specific size in a specific position, when the changed screen position information is received according to the present invention, the position of the object to be rendered or the channel to be rendered may be changed using the relative value between the changed screen position information and the initial screen information.

To update object sound source information by the proposed method, depth information of an object that maintains a distance from a screen (or becomes far from or close to the screen) should be determined when content is generated, and should be included in the object position information.

The depth information of an object may also be obtained using existing object sound source information and screen position information. The object position calibration unit 1030 updates the object sound source information by calculating the position angle of the object based on a user in consideration of both the depth information of the decoded object and the distance between the user and the screen. The updated object position information and the rendering matrix update information, which is calculated by the initial calibration unit 1010 and user position calibration unit 1020, are transmitted to the flexible rendering stage, and are used to generate a final speaker channel signal.

Consequently, the proposed invention relates to a rendering technique for assigning an object sound source to each speaker output. In other words, gain and delay values for calibrating the localization of the object sound source are determined by receiving object header (position) information, including time/spatial position information of the object, position information that represents unconformity between a screen and a speaker, and position/rotation information of a user's head.

To update object sound source information by the proposed method, depth information of an object that maintains a distance from a screen (or becomes far from or close to the screen) should be determined when content is generated, and should be included in the object position information. The depth information of an object may also be obtained using existing object sound source information and screen position information. The object position calibration unit updates the object sound source information by calculating the position angle of the object based on a user in consideration of both the depth information of the decoded object and the distance between the user and the screen. The updated object position information and the rendering matrix update information, which is calculated by the initial calibration unit and user position calibration unit, are transmitted to the flexible rendering stage, and are used to generate a final speaker channel signal.

Consequently, the proposed invention relates to a rendering technique for assigning an object sound source to each speaker output. In other words, gain and delay values for calibrating the localization of the object sound source are determined by receiving object header (position) information, including time/spatial position information of the object, position information that represents unconformity between a screen and a speaker, and position/rotation information of a user's head.

The audio signal processing method according to the present invention may be implemented as a program that can be executed by various computer means. In this case, the program may be recorded on a computer-readable storage medium. Also, multimedia data having a data structure according to the present invention may be recorded on the computer-readable storage medium.

The computer-readable storage medium may include all types of storage media to record data readable by a computer system. Examples of the computer-readable storage medium include the following: ROM, RAM, CD-ROM, magnetic tapes, floppy disks, optical data storage, and the like. Also, the computer-readable storage medium may be implemented in the form of carrier waves (for example, transmission over the Internet). Also, the bit-stream generated by the above-described encoding method may be recorded on the computer-readable storage medium, or may be transmitted using a wired/wireless communication network.

Meanwhile, the present invention is not limited to the above-described embodiments, and may be changed and modified without departing from the gist of the present invention, and it should be understood that the technical spirit of such changes and modifications also belong to the scope of the accompanying claims.

The embodiment of the present invention is provided for allowing those skilled in the art to more clearly comprehend the present invention. Therefore, the shape and size of the elements shown in the drawings may be exaggeratedly drawn for clear description.

It will be understood that, although the terms "first," "second," "A," "B," "(a)," "(b)," etc., may be used to describe components of the present invention, these terms are only used to distinguish one component from another component. Thus, the nature, sequence, or order of the components is not limited by these terms.

What is claimed is:

1. An audio signal processing method performed by an audio signal processing device, comprising:

receiving a bit-stream including at least one of a channel signal and an object signal;

receiving user environment information;

decoding at least one of the channel signal and the object signal based on the received bit-stream;

generating a reproduction signal through a flexible renderer based on the user environment information and at least one of the channel signal and the object signal;

determining gain and delay in consideration of information on at least one of a speaker's position and a user's position; and applying the gain and delay to the reproduction signal, wherein the generating the reproduction signal generates a first reproduction signal in which the decoded channel signal and the decoded object signal are combined, using information about a user reproduction channel derived based on the user environment information, and wherein the generating the reproduction signal comprises:

selecting three (3) channel signals that are adjacent to the object signal using position information of the object signal when the information about the user reproduction channel derived based on the user environment information corresponds to 22.2 channels;

multiplying the object signal by a gain value; and combining the multiplied result with at least one of the selected channel signals.

2. The audio signal processing method of claim 1, further comprising:

determining whether the user environment information corresponds to a range designated by a standard specification, wherein the generating the reproduction signal is performed by mapping at least one of the channel signal and the object signal to an available channel signal according to the user environment information when the user environment information does not correspond to the range designated by the standard specification.

3. The audio signal processing method of claim 1, wherein generating the reproduction signal generates a second reproduction signal in which the decoded channel signal and the decoded object signal are included, using information about a user reproduction channel derived based on the user environment information.

4. The audio signal processing method of claim 1, further comprising:

generating information about a user reproduction channel, wherein the generating information about the user reproduction channel comprises distinguishing an object included in a space range, in which the object is reproducible based on a changed speaker position, from an object that is not included in the space range, in which the object is reproducible.

5. The audio signal processing method of claim 1, wherein selecting the channel signal comprises:

selecting three (3) or fewer channel signals that are adjacent to the object signal when the information about the user reproduction channel derived based on the user environment information does not correspond to 22.2 channels; and multiplying the object signal by a gain value that is calculated using sound attenuation information according to a distance, and combining a result with the selected channel signal.

6. The audio signal processing method of claim 1, wherein:

receiving the bit-stream comprises receiving a bit-stream further including object end information; and decoding at least one of the channel signal and the object signal comprises decoding the object signal and the object end information, using the received bit-stream and received user environment information, decoding further comprises:

generating a decoding object list using the received bit-stream and the received user environment information;

generating an updated decoding object list using the decoded object end information and the generated decoding object list; and transmitting the decoded object signal and the updated decoding object list to the flexible renderer.

7. The audio signal processing method of claim 6, wherein generating the updated decoding object list is configured to remove a corresponding item of an object that includes the object end information from the decoding object list that is generated from object information of a previous frame, and add a new object.

8. The audio signal processing method of claim 7, wherein generating the updated decoding object list comprises:

storing a frequency of use of a past object; and being substituted by a new object using the stored frequency of use.

9. The audio signal processing method of claim 7, wherein generating the updated decoding object list comprises:

storing a usage time of a past object; and being substituted by a new object using the stored usage time.

10. The audio signal processing method of claim 6, wherein the object end information is implemented by adding one or more bits of different additional information to an object sound source header according to a reproduction environment.

11. The audio signal processing method of claim 6, wherein the object end information is capable of reducing traffic.

* * * * *